United States Patent [19]

Kakino et al.

[11] Patent Number: 4,511,412

[45] Date of Patent: Apr. 16, 1985

[54] METHOD OF PRODUCING A WATER-IN-OIL EMULSION EXPOSIVE

[75] Inventors: Shigeru Kakino; Katsuhide Hattori; Yoshiaki Fukatsu, all of Chita; Hideo Moriyama, Tokoname; Hidekazu Sakakibara, Handa, all of Japan

[73] Assignee: Nippon Oil and Fats Co. Ltd., Japan

[21] Appl. No.: 632,869

[22] Filed: Jul. 20, 1984

[30] Foreign Application Priority Data

Aug. 1, 1983 [JP] Japan ..... 58-140923

[51] Int. Cl.[3] ..... D03D 23/00

[52] U.S. Cl. ..... 149/109.6; 149/2; 149/21; 149/46

[58] Field of Search ..... 149/2, 21, 109.6, 46

[56] References Cited

U.S. PATENT DOCUMENTS 4,216,040 8/1980 Sudweeks et al. ..... 149/2
4,315,784 2/1982 Hattori et al. ..... 149/2
4,315,787 2/1982 Hattori et al. ..... 149/2
4,394,198 7/1983 Takeuchi et al. ..... 149/2
4,398,976 8/1983 Hattori et al. ..... 149/2
4,410,378 10/1983 Hattori et al. ..... 149/2
4,414,044 11/1983 Takeuchi et al. ..... 149/2

*Primary Examiner*—Stephen J. Lechert, Jr.
*Attorney, Agent, or Firm*—Parkhurst and Oliff

[57] ABSTRACT

A water-in-oil emulsion explosive, comprising aqueous inorganic oxidizer solution, oil, emulsifier and hollow microspheres, and having high low-temperature detonability and storage stability can be produced without causing breakage of the hollow microspheres through a specifically limited kneading method, wherein agitating blades fitted to an agitating shaft in a kneader are subjected to up and down movements in the axial directions of the agitating shaft and concurrently to a rotary motion to knead homogeneously a water-in-oil emulsion formed of the aqueous solution of inorganic oxidizer, oil and emulsifier, together with the hollow microspheres.

1 Claim, 3 Drawing Figures

METHOD OF PRODUCING A WATER-IN-OIL EMULSION EXPOSIVE

BACKGROUND OF THE INVENTION (1) Field of the Invention

The present invention relates to a method of producing water-in-oil emulsion explosive (hereinafter, referred to as W/O emulsion explosive), and more particularly relates to a method of producing W/O emulsion explosive commercially advantageously, wherein relatively unstable hollow microspheres can be stably kneaded with W/O emulsion in a short time through a kneading step, wherein agitating blades fitted to an agitating shaft in a kneader are moved in the axial directions of the agitating shaft and are concurrently rotated to improve the kneading efficiency, and the kneaded mixture is exhausted from the kneader by means of extruding blades fitted to the lower portion of the agitating shaft.

(2) Description of the Prior Art

It is generally important to produce safely W/O emulsion explosion in a commercial scale and to control the quality of the resulting explosive regardless of continuous process and batch process.

U.S. Pat. No. 4,138,281 specification discloses a method of producing W/O emulsion explosive comprising aqueous solution of inorganic oxidizer, oil, emulsifier and hollow microspheres. This method comprises five steps as illustrated in FIG. 1, that is, a step for conditioning an aqueous solution of inorganic oxidizer, a step for conditioning a mixture of oil and emulsifier, a step for emulsifying the mixture of oil and emulsifier together with the above described aqueous solution of inorganic oxidizer into a W/O emulsion, a step for kneading the resulting W/O emulsion together with hollow microspheres, and a step for packing the resulting W/O emulsion explosive. Among these steps, the emulsifying and kneading steps are most important. It is necessary to produce a strong W/O emulsion in the emulsifying step, and whether the resulting W/O emulsion has been fully emulsified or not has a high influence upon the quality and storage stability of the W/O emulsion explosive produced from the emulsion. Particularly, when the formation of emulsion is insufficient, the resulting W/O emulsion explosive deteriorates in its detonation sensitivity at low temperatures and in its explosion performance during its storage for a long period of time. The kneading step is carried out in order to knead homogenously a W/O emulsion having a relatively large specific gravity with hollow microspheres having a very small specific gravity. In this case, the hollow microspheres are easily broken by mechanical shear due to their inherent property and therefore it is an important problem how to knead the hollow microspheres with a W/O emulsion within a short time without causing breakage. Even when a W/O emulsion and hollow microspheres can be homogeneously kneaded, if the hollow microspheres are broken during the kneading, the resulting explosive is poor in the quality and is very poor in the explosion performance.

The inventors have variously attempted for a long period of time in order to solve the above described problems and to develop a new technic, and have newly found out a very excellent kneading method. Further, the inventors have ascertained that a W/O emulsion explosive produced by the newly found out method is less in breakage of hollow microspheres, and is more excellent in homogeneity than W/O emulsion explosives produced by a conventional method, and further ascertained that the W/O emulsion explosive of the present invention is superior or equal to the conventional W/O emulsion explosives in explosion performance and other properties. As the result, the present invention has been accomplished.

SUMMARY OF THE INVENTION

The feature of the present invention is the provision of a method of producing water-in-oil emulsion explosive, comprising a step for conditioning an aqueous solution of inorganic oxidizer, a step for conditioning an oil, an emulsifier, or a mixture of oil and emulsifier, a step for mixing the aqueous solution of inorganic oxidizer with the oil and the emulsifier, a step for emulsifying the resulting mixture to form a water-in-oil emulsion, a step for kneading the resulting water-in-oil emulsion together with hollow microspheres, and a step for packing the resulting water-in-oil emulsion explosive, the improvement comprising said kneading step being a kneading step, wherein the agitating blades fixed to an agitating shaft in a kneader are subjected to up and down movements in the axial directions of the agitating shaft and concurrently to a rotary motion together with the agitating shaft to knead a water-in-oil emulsion together with hollow microspheres, and the resulting kneaded mixture is exhausted from the bottom portion of the kneader or taken out from the upper portion thereof.

DESCRIPTION OF THE PREFERRED EMBODIMENT

Figure 1:
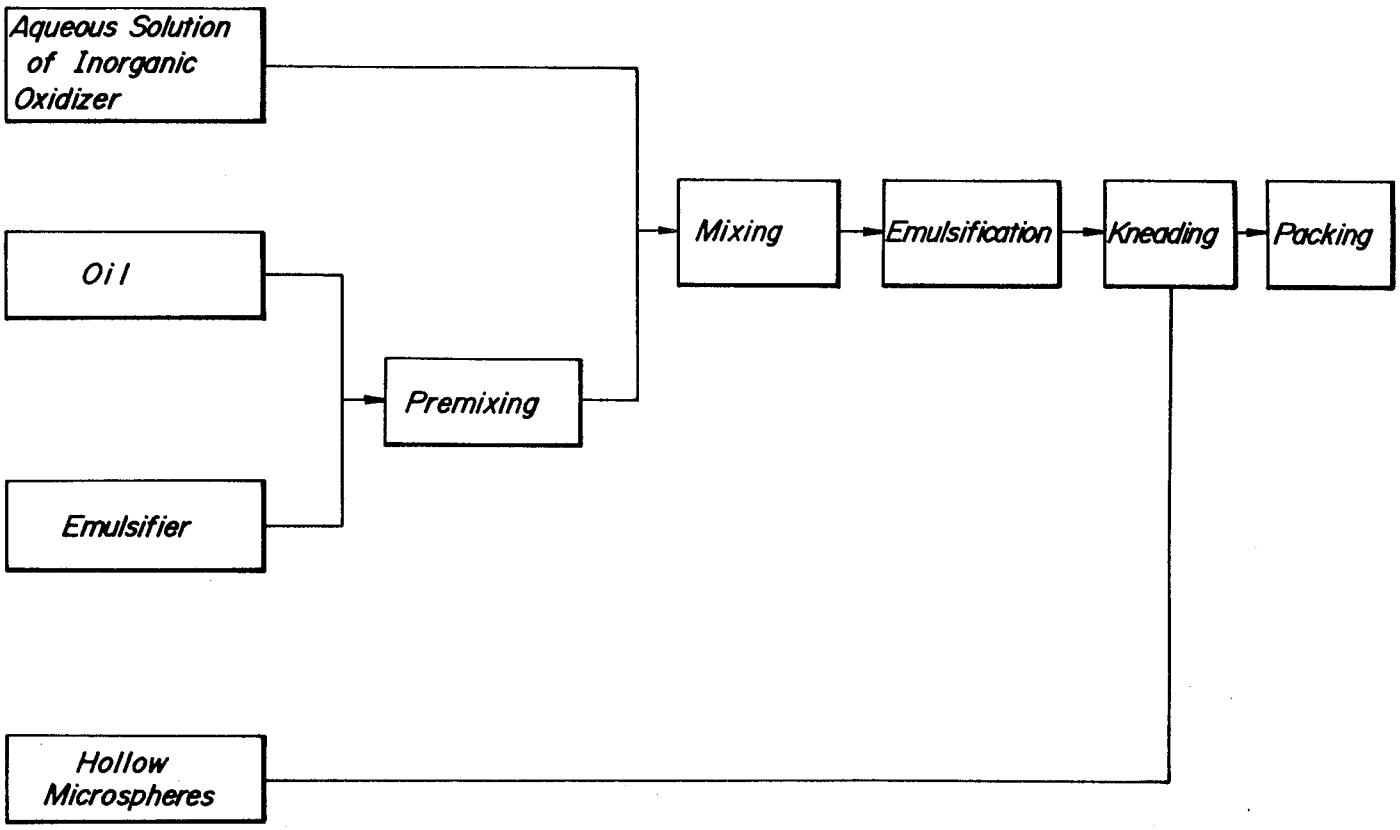
FIG. 1 is a flow sheet illustrating a conventional method of producing W/O emulsion explosive.

The W/O emulsion to be used in the present invention may be ones produced by a conventional emulsifying method and having a commonly known composition.

The hollow microspheres to be used in the present invention include inorganic hollow microspheres, such as glass, alumina, shirasu (shirasu is a kind of volcanic ash) hollow microspheres and the like; carbonaceous hollow microspheres, such as pitch hollow microspheres and the like; and synthetic resin hollow microspheres, such as phenolic resin, Saran hollow microspheres and the like.

In the present invention, 99–90% (in weight basis, hereinafter "%" means % by weight) of a W/O emulsion and 1–10% of hollow microspheres are generally kneaded in the kneading step.

Hereinafter, the present invention will be explained in more detail referring to the drawings.

Figure 2:
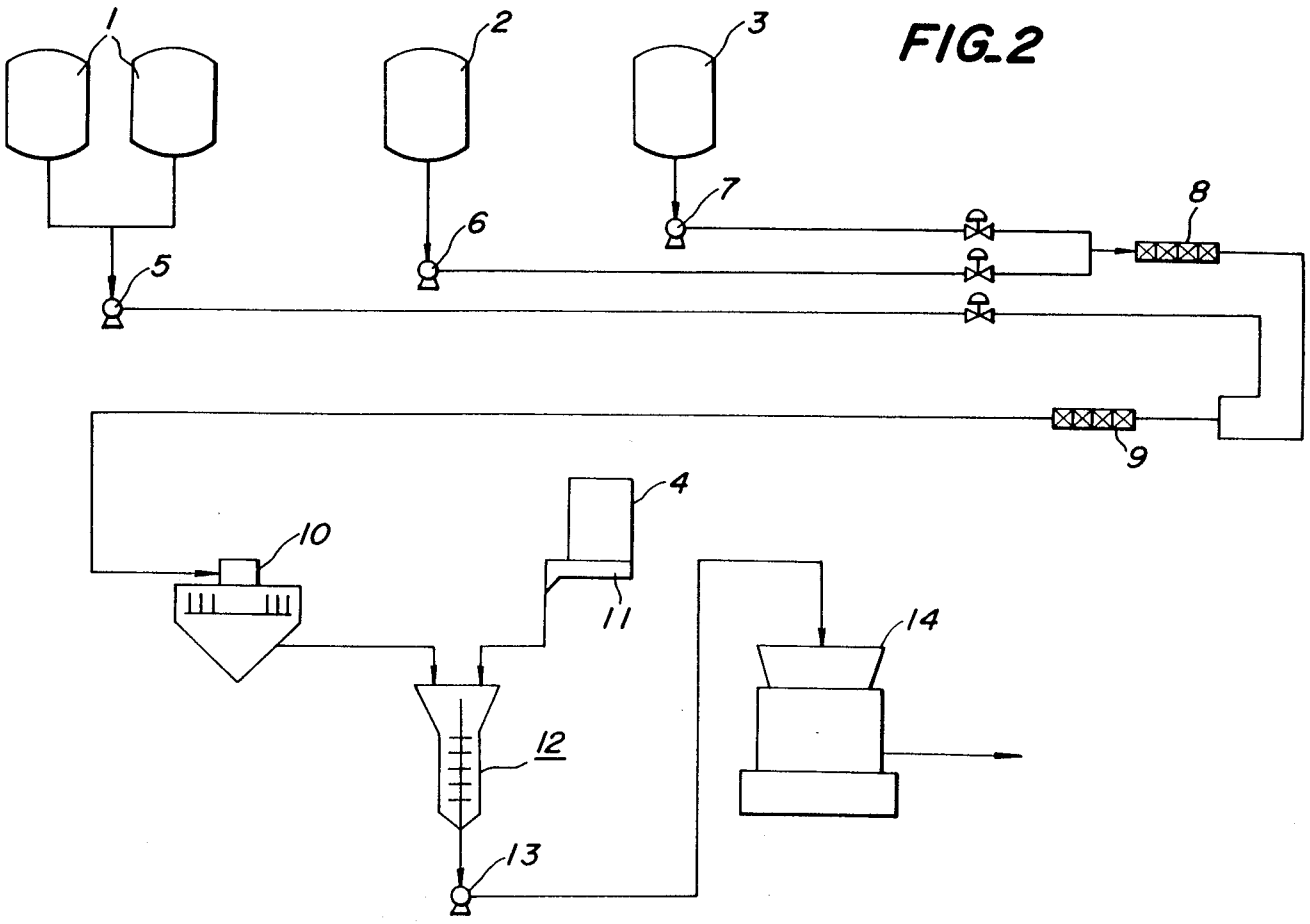
FIG. 2 is a flow sheet illustrating one embodiment of the method of the present invention for producing W/O emulsion explosive.
Figure 3:
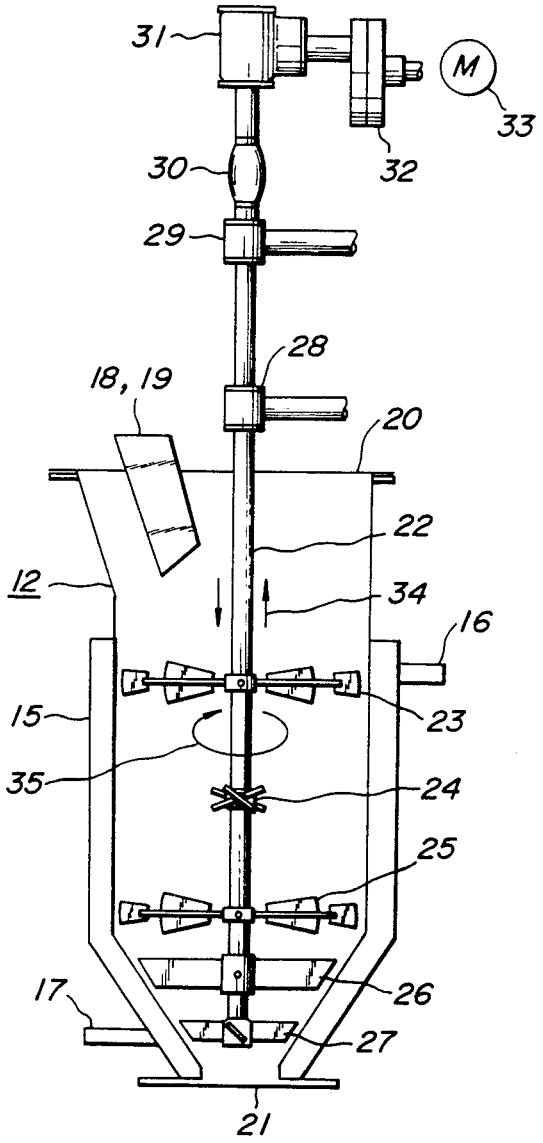
FIG. 3 is a vertical sectional view of one embodiment of a kneader used in the kneading step in the present invention.

FIG. 2 is a flow sheet illustrating one embodiment of the method of the present invention for producing W/O emulsion explosive; and FIG. 3 is a vertical sectional view of one embodiment of a kneader to be used in the kneading step in the present invention.

Referring to FIG. 2, an aqueous solution of inorganic oxidizer is kept at a temperature (generally 70°-130° C.) not less than the crystallization temperature of the inorganic oxidizer in a tank 1 for aqueous solution of oxidizer; an oil and an emulsifier are heated and kept at about 70°-100° C. in an oil tank 2 and in a melting tank 3, respectively; and hollow microspheres are kept in a feeder 4 for powdery material.

The oil and emulsifier heated to a given temperature are flowed by means of supply pumps 6 and 7 respectively, and are controlled to given flow rates by means of respective flow rate regulators. The quantitatively supplied two liquids are premixed in a static mixer 8, and the premixture of oil and emulsifier is fed into another static mixer 9. The aqueous solution of inorganic oxidizer heated up to a given temperature is flowed by means of a supply pump 5, is controlled to a given flow rate by means of a flow rate regulator at the same time with the flow rate control of the oil and emulsifier, and then fed into the static mixer 9 at the above controlled flow rate. The aqueous solution of inorganic oxidizer fed into the static mixer 9 is mixed therein with the above described premixture of oil and emulsifier, and the resulting mixture is fed into an emulsifying machine 10 and emulsified therein in a short time to form a W/O emulsion. The resulting W/O emulsion is exhausted from the emulsifying machine 10, and then fed into a kneader 12. The hollow microspheres to be kneaded with the W/O emulsion are concurrently fed into the kneader 12 from the feeder 4 for powdery material through a metering feeder 11 for powdery material.

In the kneader 12, the above described W/O emulsion and hollow microspheres are homogeneously kneaded in a high efficiency to form a W/O emulsion explosive composition, and the resulting explosive composition is fed into a packing machine 14 by means of a pump 13, and a W/O emulsion explosive is produced therein.

Hereinafter, an explanation will be made with respect to the kneader to be used in the characteristic kneading step of the present invention referring to FIG. 3.

A kneader 12 consists of an agitating shaft 22 which has agitating blades 23, 24 and 25, each being arranged in a direction perpendicular to the direction of the shaft and being shifted by 90° from each other, and extruding blades 26 and 27; an upper cover 20 having a feed inlet 18 for emulsion and a feed inlet 19 for hollow microspheres; a bottom exhausting hole 21 and a jacket 15.

The agitating shaft 22 is held by two upper and lower bearings 29 and 28, and is connected to a motor 33 through universal joints 30 and 31 and an eccentric coupling 32. The universal joints and eccentric coupling serve to move the shaft in up and down directions. Arrows 34 indicate the up and down movements of the shaft. The motor is provided with a reduction gear which can freely change the number of rotations of the agitating shaft generally within the range of 30-200 rpm. An arrow 35 indicates the rotary motion of the shaft. The stroke in the up and down movements and the number of strokes of the agitating shaft can be controlled within the ranges of 30-100 mm and 28-190 spm. respectively by changing the gears of the eccentric coupling 32 and the universal joint 31, and the like. In this case, the agitating blade is not moved on the same locus in the kneader by changing a little the number of rotations of the shaft from the number of strokes thereof. That is, due to the agitation by the concurrent rotary motion and up and down movements of the agitating blade, a W/O emulsion having a high viscosity and hollow microspheres having a very small specific gravity can be kneaded in a short time without causing breakages of the W/O emulsion and hollow microspheres. The up and down movements of the shaft further serve to extrude the W/O emulsion explosive composition formed in the kneader. The extruding blades 26 and 27 serve to extrude the explosive composition. When the exhaust hole 21 arranged at the bottom of the kneader is made into such a structure that its cross-sectional area can be changed by means of a slide type damper or the like, the residence time of the kneaded mixture in the kneader can be varied, and the kneaded state thereof can be varied.

As described above, the method of producing W/O emulsion explosive according to the present invention can knead homogeneously W/O emulsion and hollow microspheres in the kneading step in a shorter time without causing breakages of the emulsion and hollow microspheres than the conventional method. Further, the kneader of the present invention has a sealing means for the shaft at the exterior of the kneader. Therefore, the kneading method of the present invention is safer than the conventional method, and is commercially advantageous.

The method of the present invention for producing W/O emulsion explosive will be explained referring to examples and comparative examples.

COMPARATIVE EXAMPLE 1

A W/O emulsion explosive was produced through the steps illustrated in FIG. 1 according to the following method.

Into a tank of 2,000 l capacity were charged 900 kg of ammonium nitrate, 50 kg of sodium chlorate and 100 kg of water, and the resulting mixture was heated to prepare an aqueous solution of inorganic oxidizer kept at 90° C. Into another tank of 200 l capacity were charged 20.1 kg of an emulsifier and 40.2 kg of paraffin, and the resulting mixture was heated, melted and premixed to prepare a liquid mixture kept at 90° C.

The above obtained aqueous solution of inorganic oxidizer was fed into a static mixer at a flow rate of 18.0 kg/min by means of a plunger pump. At the same time, the above obtained liquid mixture was fed into the static mixer at a flow rate of 1.03 kg/min by means of a plunger pump to form a mixture of the aqueous solution of inorganic oxidizer and the liquid mixture therein. The mixture flowed out from the static mixer was fed into an emulsifying machine provided in its interior with a homoginizing disc, and emulsified therein at a rotation number of 700 rpm (peripheral speed: 10 m/sec) to obtain a W/O emulsion.

The resulting W/O emulsion was fed into a kneader, and at the same time glass hollow microspheres were fed into the kneader at a flow rate of 380 g/min, and the resulting mixture was continuously kneaded at a rotation number of 180 rpm. The residence time of the mass in the kneader was 30 seconds. After the kneading, the resulting W/O emulsion explosive composition was fed into a tube packing machine by means of a pump, and packed into two kinds of W/O emulsion explosive cartridges, one of which had a diameter of 25 mm (100 g) and the other of which had a diameter of 50 mm (1 kg).

The resulting W/O emulsion explosive cartridges were measured just after the production and one year after the production with respect to the density, the detonation velocity at 20° C. by means of a No. 6 electric blasting cap under an unconfined state, and the lowest detonation temperature (low temperature detonability). Further, the breakage of the hollow microspheres during the kneading was measured.

The obtained results are shown in the following Table 1.

EXAMPLE 1

A W/O emulsion explosive was produced through the steps illustrated in FIG. 2 according to the following method. The kind and amount of the raw materials used in this Example 1 are the same as those used in the Comparative example 1.

An aqueous solution of inorganic oxidizer was prepared in a tank 1 and kept at 90° C. Paraffin and an emulsifier were melted in an oil tank 2 and a melting tank 3 respectively, and kept at 90° C. The aqueous solution of inorganic oxidizer, paraffin and emulsifier were quantitatively flowed by means of feed pumps 5, 6 and 7, respectively. The paraffin and emulsifier were premixed in a static mixer 8, and the resulting mixture was fed into another static mixer 9 at a flow rate of 1.03 kg/min. At the same time, the aqueous solution of inorganic oxidizer was fed into the static mixer 9 at a flow rate of 18.0 kg/min, and mixed therein with the mixture of paraffin and emulsifier. In this experiment, the quantitativeness of the raw materials was not secured by the control of flow rate ratio but secured by using metering pumps. The mixture formed in the static mixer 9 was fed into an emulsifying machine 10 of 3 l capacity and emulsified therein. After 10 second residence in the emulsifying machine 10, the resulting W/O emulsion was flowed out from the emulsifying machine and then fed into a kneader 12 and kneaded therein together with glass hollow microspheres, which were concurrently fed into the kneader 12 from a feeder 4 for powdery material by means of a metering feeder 11 for powdery material at a flow rate of 380 g/min. The agitating blade of the kneader was rotated at a rate of 90 rpm (peripheral speed: 1 m/sec). By a residence time of 30 seconds in the kneader, a homogeneously kneaded mixture was obtained.

The resulting W/O emulsion explosive composition was fed into a packing machine 14 (tube packing machine) by means of a pump 13, and packed into two kinds of W/O emulsion explosive cartridges which had the same diameters as those in Comparative example 1.

The resulting two kinds of W/O emulsion explosive cartridges were subjected to the same tests as described in the Comparative example 1. The obtained results as shown in Table 1.

TABLE 1

| | | Example 1 | | Comparative Example 1 | |
|---|---|---|---|---|---|
| | | Cartridge diameter (mm) | | | |
| | | 25Ø | 50Ø | 25Ø | 50Ø |
| Just after the production | Density | 1.18 | 1.19 | 1.22 | 1.23 |
| | Detonation velocity at 20° C. (m/sec) | 5,150 | 5,560 | 4,820 | 5,100 |
| | Low temperature detonability (°C.) | −35 | −35 | −15 | −20 |
| | Breakage of glass hollow microspheres (wt. %) *1 | 3 | | 21 | |
| One year after the production | Density | 1.19 | 1.21 | 1.24 | 1.25 |
| | Detonation velocity at 20° C. (m/sec) | 5,050 | 5,320 | 4,280 | 4,530 |
| | Low temperature detonability (°C.) | −25 | −25 | +15 | +10 |

Note:
*1 Measurement of breakage is carried out on an explosive composition sampled at the outlet of the kneader (Percentage of explosive broken only in the interior of the kneader).

COMPARATIVE EXAMPLE 2

A W/O emulsion explosive was produced by a batch system kneading method by means of a vertical type kneader. The kind and amount of starting materials, and the production method of a W/O emulsion to be fed into the kneader were the same as those described in Comparative example 1. The amounts of the W/O emulsion and hollow microspheres used in one batch were as follows: a W/O emulsion (produced by means of an emulsifying machine provided in its interior with a homogenizing disc): 57.09 kg, and glass hollow microspheres: 1,140 g. After kneading, the resulting W/O emulsion explosive composition was packed into two kinds of W/O emulsion explosive cartridges having the same diameters as those of Comparative example 1 by means of a paper packing machine, and subjected to the same tests as described in Comparative example 1. The obtained results are shown in Table 2.

EXAMPLE 2

A W/O emulsion explosive was produced by a batch system kneading method by means of the same vertical type kneader as used in Comparative example 2. The kind and amount of starting materials, the production method of a W/O emulsion to be fed into the kneader, and the batch treatment condition were the same as those described in Comparative example 2. After kneading, the resulting W/O emulsion explosive composition was packed into two kinds of W/O emulsion explosive cartridges having the same diameters as those in Comparative example 2 in the same manner as described in Comparative example 2, and subjected to the same tests as described in Comparative example 1. The obtained results are shown in Table 2.

TABLE 2

| | | Example 2 | | Comparative Example 2 | |
|---|---|---|---|---|---|
| | | Cartridge diameter (mm) | | | |
| | | 25Ø | 50Ø | 25Ø | 50Ø |
| Just after the production | Density | 1.18 | 1.18 | 1.20 | 1.22 |
| | Detonation velocity at 20° C. (m/sec) | 5,100 | 5,450 | 4,960 | 5,210 |
| | Low temperature detonability (°C.) | −35 | −35 | −25 | −30 |
| | Breakage of glass hollow microspheres (wt. %) | 7 | | 15 | |
| | Kneading time (sec) | 55 | | 140 | |

TABLE 2-continued

| | | Example 2 | | Comparative Example 2 | |
|---|---|---|---|---|---|
| | | Cartridge diameter (mm) | | | |
| | | 25Ø | 50Ø | 25Ø | 50Ø |
| One year after the production | Density | 1.20 | 1.21 | 1.22 | 1.23 |
| | Detonation velocity at 20° C. (m/sec) | 5,000 | 5,310 | 4,530 | 5,110 |
| | Low temperature detonability (°C.) | −25 | −25 | 0 | −10 |

It can be seen from Table 1 that the W/O emulsion explosive (Example 1) produced by the continuous kneading method according to the present invention is superior to the W/O emulsion explosive (Comparative example 1) produced by a conventional continuous kneading method in any of performances of explosive itself and further is lower than the conventional emulsion explosive in the breakage of hollow microspheres. Therefore, according to the present invention, the amount of hollow microspheres to be contained in a W/O emulsion explosive as a specific gravity controller for the explosive can be decreased and an explosive having a high performance can be inexpensively produced.

Further, it can be seen from Table 2 that the W/O emulsion explosive (Example 2) produced by the batch system kneading method of the present invention is superior to the W/O emulsion explosive (Comparative example 2) produced by a conventional batch system kneading method, and is excellent in the performance, is low in the breakage of hollow microspheres and is high in the kneading efficiency similarly to the W/O emulsion explosive produced by a continuous kneading method according to the present invention. Accordingly, it has been ascertained that the kneading time in the batch system kneading method of the present invention is shorter than one-half of the kneading time in the conventional batch system kneading method.

What is claimed is:

1. In a method of producing water-in-oil emulsion explosive, comprising a step for conditioning an aqueous solution of inorganic oxidizer, a step for conditioning an oil, an emulsifier, or a mixture of oil and emulsifier, a step for mixing the aqueous solution of inorganic oxidizer with the oil and the emulsifier, a step for emulsifying the resulting mixture to form a water-in-oil emulsion, a step for kneading the resulting water-in-oil emulsion together with hollow microspheres, and a step for packing the resulting water-in-oil emulsion explosive, the improvement comprising said kneading step being a kneading step, wherein agitating blades fitted to an agitating shaft in a kneader are subjected to up and down movements in the axial directions of the agitating shaft and concurrently to a rotary motion together with the agitating shaft to knead the water-in-oil emulsion together with hollow microspheres, and the resulting kneaded mixture is exhausted from the bottom portion of the kneader or taken out from the upper portion thereof.

* * * * *